US005291873A

United States Patent [19]

Hirschmann et al.

[11] Patent Number: 5,291,873

[45] Date of Patent: Mar. 8, 1994

[54] METHOD AND ARRANGEMENT FOR DETERMINING A PARAMETER OF A LAMBDA CONTROLLER

[75] Inventors: Klaus Hirschmann, Leonberg; Lothar Raff, Remseck; Lutz Reuschenbach, Stuttgart; Eberhard Schnaibel, Hemmingen, all of Fed. Rep. of Germany

[73] Assignee: Robert Bosch GmbH, Stuttgart

[21] Appl. No.: 895,550

[22] Filed: Jun. 8, 1992

[30] Foreign Application Priority Data

Jun. 6, 1991 [DE] Fed. Rep. of Germany ..... 4118575

[51] Int. Cl.[5] ..... F02D 41/14

[52] U.S. Cl. ..... 123/682

[58] Field of Search ..... 123/682, 675, 696, 681, 123/679, 680, 683, 684, 687

[56] References Cited

U.S. PATENT DOCUMENTS

| | | | |
|---|---|---|---|
| 4,075,982 | 2/1978 | Asano et al. | 123/682 |
| 4,241,710 | 12/1980 | Peterson, Jr. et al. | 123/682 |
| 4,442,817 | 4/1984 | Auth et al. | 123/696 |
| 4,461,258 | 7/1984 | Becker et al. | 123/681 |

FOREIGN PATENT DOCUMENTS

| | | | |
|---|---|---|---|
| 62-82249 | 4/1987 | Japan | 123/682 |

*Primary Examiner*—Andrew M. Dolinar
*Attorney, Agent, or Firm*—Walter Ottesen

[57] ABSTRACT

The invention is directed to a method for determining the particular current value of at least one control parameter for a lambda control of an internal combustion engine which provides a shift to make the fuel mixture lean or a shift to make the fuel mixture rich in dependence upon the operating state of the controlled engine. The method includes the steps of: determining a base value for the control parameter in dependence upon the current value of at least one pregiven operating variable as the current value applies for a control with a minimal discharge of toxic gas during steady-state operation of the engine; and, modifying the base value with a transition variable having a value decaying as a function of time when changes in the operating state of the engine occur. The method of the invention affords the advantage that the control parameter does not have a value which was applied for a minimum discharge of toxic gas for a typical operation sequence at steady-state or transient operation; instead, for steady-state and transient operations, optimized values are available. In this way, a discharge of exhaust gas is obtained which is lower compared to possibilities which have existed up until now.

11 Claims, 2 Drawing Sheets

METHOD AND ARRANGEMENT FOR DETERMINING A PARAMETER OF A LAMBDA CONTROLLER

FIELD OF THE INVENTION

The invention relates to a method and an arrangement for determining the actual value of at least one control parameter for a lambda control in dependence upon the particular actual operating state of the internal combustion engine on which the lambda control is utilized.

BACKGROUND OF THE INVENTION

A method and an arrangement for the above-mentioned purpose are described in U.S. Pat. No. 4,461,258. The arrangement includes at least one characteristic field for the values of a control parameter which can be addressed via values of pregiven operating variables such as engine speed and load. In this way, control frequency and/or control condition can be adapted to the particular actual operating state of the controlled engine so that an especially low discharge of toxic gas from the engine takes place, that is, a discharge from a catalytic converter following the engine.

U.S. Pat. No. 4,461,258 discloses that the average values for λ can be shifted in a clearly defined manner such that the individual exhaust gas components are substantially adapted to the desired value at all operational points.

Values of control parameters which lead to a minimum discharge of toxic gas are not only dependent upon the actual operating state of the engine but also upon the way in which this operating state was reached. For example, if an operating state having a high engine output and therefore a high engine temperature is reached from a very low power output, another time-dependent pattern of exhaust gas discharge from the engine is to be expected in accordance with start value and time constant (because of the dependence of the exhaust gas composition on the combustion temperature) than if the same operating state is reached starting from such a power output which is very similar. The exhaust gas temperature is also dependent upon the combustion temperature, which, in turn, determines the temperature of the catalytic converter. This temperature influences the conversion characteristics of the catalytic converter. In the known arrangement, the values stored in the particular characteristic field are so applied that they collectively lead to minimum toxic gas discharge from the catalytic converter for typical predetermined operating sequences.

Since the above-mentioned method and arrangement have been known, the need has been present to provide a corresponding method and arrangement which make it possible to further drop the exhaust gas discharge.

SUMMARY OF THE INVENTION

The method of the invention is for determining the particular current value of at least one control parameter for a lambda control of an internal combustion engine which provides a shift to make the fuel mixture lean or a shift to make the fuel mixture rich in dependence upon the operating state of the controlled engine. The method includes the steps of: determining a base value for the control parameter in dependence upon the current value of at least one pregiven operating variable as the current value applies for a control with a minimal discharge of toxic gas during steady-state operation of the engine; and, modifying the base value with a transition variable having a value decaying as a function of time when changes in the operating state of the engine occur.

The above method affords the advantage that optimal values for an affected control parameter are available for steady-state operation as well as for transient operation. This procedure leads to an especially low discharge of exhaust gas since the particular actual value of the affected control parameter is no longer dependent only upon the actual operating state of the controlled engine but also on the operating state changes. The steady-state operation takes place more frequently and the values from the base value characteristic field which are optimized for this operation can be used with these values, reduced toxic gas discharge is obtained in steady-state operation compared to the values stored in a conventional control parameter characteristic field which values had been optimized to minimum exhaust gas discharge over steady-state and transient operations.

In the simplest embodiment, the transition value, which had been added to a particular base value, has a fixed start value and this transition value decays with a fixed pregiven time constant. It is more advantageous to change the start value and/or the time constant in dependence upon values of operating variables.

The start value of the transition variable is adapted in at least one of two ways to the particular operating state of the engine in an advantageous manner. In one of these two ways, the start value is read out of a characteristic field addressed via values of operating variables. The other way is to change the start value via the value or the change value of a pregiven operating variable. Accordingly, for example for low engine speeds and loads or low power outputs, a low start value is read out of a characteristic field and, at high engine speeds and loads and high power outputs, a high value is read out. The particular value read out can be increased or lowered with the aid of a determined power output value or load-change value referred to a reference value. In this way, an especially flexible method is provided for the particular optimal selection of the actual value of a control parameter.

The arrangement of the invention is for determining the particular current value of at least one control parameter for a lambda control of an internal combustion engine which provides a shift to make the fuel mixture lean or a shift to make the fuel mixture rich in dependence upon the operating state of the controlled engine. The arrangement includes: base-value characteristic field means for base values of the control parameter; means for addressing the characteristic field via values of operating variables; the characteristic field containing values of the control parameter which had been applied for a control having minimal toxic gas discharge during steady-state operation of the engine; and, modifying means for modifying a particular value read out of the base-value characteristic field with a time-decaying value of a transition variable in the case of changes in the operating state.

The modified arrangement advantageously includes a characteristic field for start values of the transition variable which is addressable via values of operating variables.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
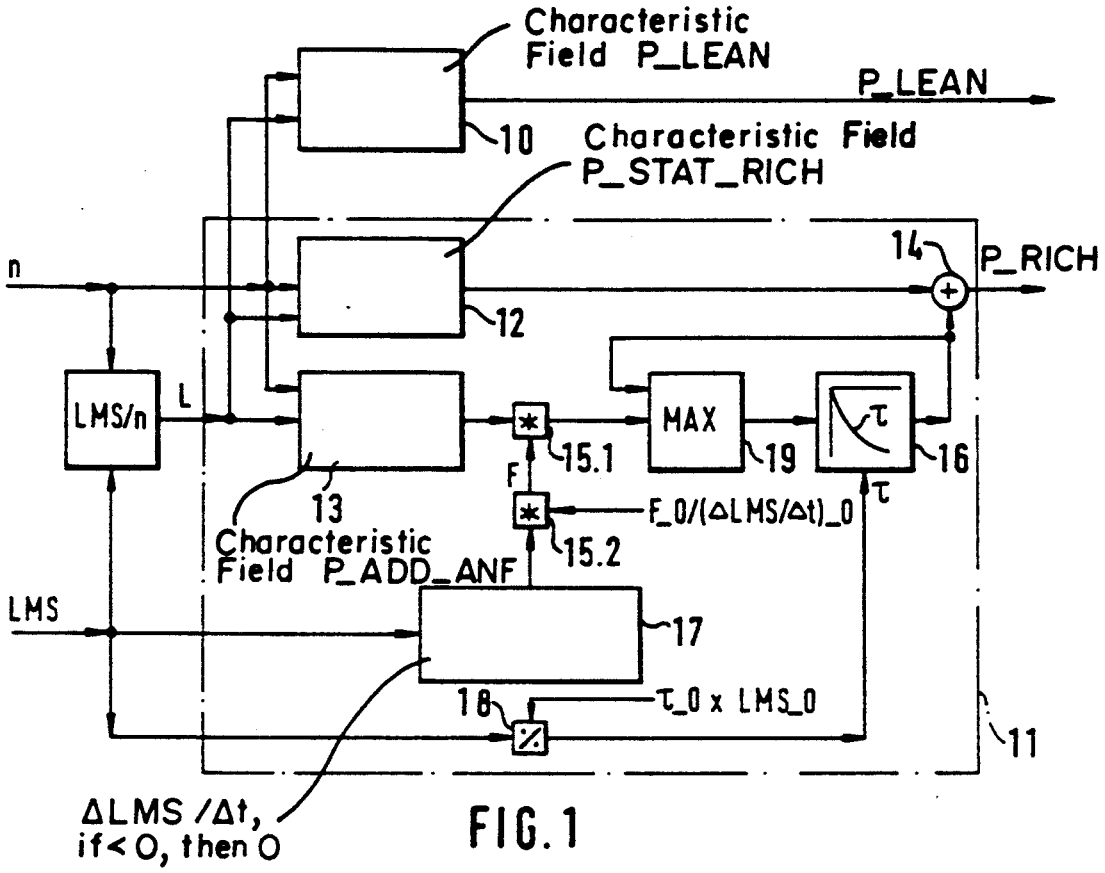
FIG. 1 is a block diagram for explaining a method and an arrangement for determining the particular actual value of the P-value of a two-point lambda control in dependence upon the particular actual values of engine speed and air-mass flow of an engine.

The block diagram of FIG. 1 will be used to explain an arrangement as well as a method for determining the particular actual P-value for the lambda control (not shown) of an engine (also not shown). The individual blocks can be viewed as units of an arrangement; however, in practice, the functional units are realized by an appropriately programmed microcomputer. The directional arrows associated with the connecting lines between the individual blocks make apparent the method of the invention which is carried out by the arrangement of the invention.

For FIG. 1, it is a precondition that a two-point lambda control is present which operates with P-values having magnitudes which are dependent upon whether a P-jump in the direction lean or in the direction rich is to be carried out. Accordingly, two P-values are provided, namely, a value P_LEAN for jumps in the direction lean and a value P_RICH for jumps in the direction rich. The first-mentioned values are supplied by a characteristic field 10 in dependence upon particular actual values of the engine speed (n) and of the air-mass flow LMS to the engine. In contrast, the last-mentioned values are supplied by an arrangement 11 which likewise is supplied with the particular actual values of engine speed and air-mass flow.

The arrangement 11 for emitting the P-values P_RICH includes a steady-state value characteristic field 12 for the steady-state values P_STAT_RICH and a start value characteristic field 13 for values P_ADD_ANF of a transition variable. The transition variable is added to a particular actual value of P_STAT_RICH in an addition unit 14. The values are emitted from the steady-state value characteristic field 12 after being addressed via engine speed (n) and load L=LMS/N. The transition values are formed from the values P_ADD_ANF read out of the characteristic field 13 in that the values P_ADD_ANF are multiplied in a first multiplier unit 15.1 by a factor F and the start value modified in this manner receives a time-dependent decay characteristic in a transition unit 16. The factor F is dependent upon the output change and is computed to $F=F_0\times\{(\Delta LMS/\Delta t)/(\Delta LMS/\Delta t)_0\}$ during a pregiven time span $\Delta t$ with the aid of the change of the air-mass flow $\Delta LMS$. The above-mentioned measures are carried out by a differential unit 17 of a second multiplier unit 15.2 and the above-mentioned multiplier unit 15.1 as shown in FIG. 1. The time constant $\tau$ of the transition unit 16 is computed in a quotient forming unit 18 from the air-mass flow LMS, a reference time constant $\tau_0$ and a reference air-mass flow LMS_0 to $\tau=\tau_0$ (LMS_0/LMS).

The method sequence carried out by the above-mentioned functional units will now be explained with the aid of an example shown in FIG. 2.

In advance of a time point T1, the engine is operated in steady-state at relatively low output over a longer time span. As a value P_RICH, a value P_STAT1 of, for example, 3% (referred to the value of the controller amplitude) is emitted by the arrangement 11 for the above-mentioned P-value. The value emitted simultaneously by the characteristic field 10 for the value P_LEAN is not shown in FIG. 2. This value is provided with no transition characteristic in the embodiment shown; instead, it is used directly as it is read out of the characteristic field 10.

It is assumed that at the above-mentioned time point T1, an increase of the power output takes place which causes an optimized value of the variable P_STAT2 of 5% of the controller amplitude for the variable P_RICH for steady-state operation at the new output. This value P_STAT2 can be addressed from the steady-state value characteristic field 12 via the values of engine speed (n) and load L corresponding to the new operating condition. At the same time, the start value characteristic field 13 supplies the start value P_ADD_ANF corresponding to the new operating condition for the above-mentioned transition variable. For the embodiment shown in FIG. 2, this value has a magnitude of 5% (again, as in the following, referred to the actual value of the controlling injection time). This value is optimized for a specific output increase which is proportional to the reference value $(\Delta LMS/\Delta t)_0$. The actual output change proportional to $\Delta LMS/\Delta T$ as it is determined in the difference unit 17 is assumed to be greater by a factor of 1.4 than the reference value. The reference value F_0 is assumed to be the value 1. Then, the factor F in the embodiment has the value 1.4 so that the actual value of the transition variable is $1.4\times5\%=7\%$. The total value for P_RICH directly after the output change is therefore $P_STAT2+F\times P_ADD_ANF=5\%+7\%=12\%$. This value falls off starting at time point T1 with the time constant 1. The value of P_STAT2 is essentially reached at a time point T3. If an output increase then takes place at a later time point, a similar situation is presented as at the time point T1.

If a new output increase takes place before the old transition value, which was obtained from the old increase, has dropped off, the question is presented as to which value should thereafter apply, namely, that value which is still present from the previous load increase or that value which has just been computed from the new output increase. In the embodiment shown, the higher value is selected and this takes place in a maximum-value determination unit 19 arranged ahead of the transition unit 16. This determination unit 19 receives the particular actual value $F\times P_ADD_ANF$ as well as the output value from the transition unit 16 as input values. Always, when the maximum value changes with respect to these two values, the determination device 19 emits the new value to the transition unit 16 as a start value for a new decaying transition value.

Figure 2:
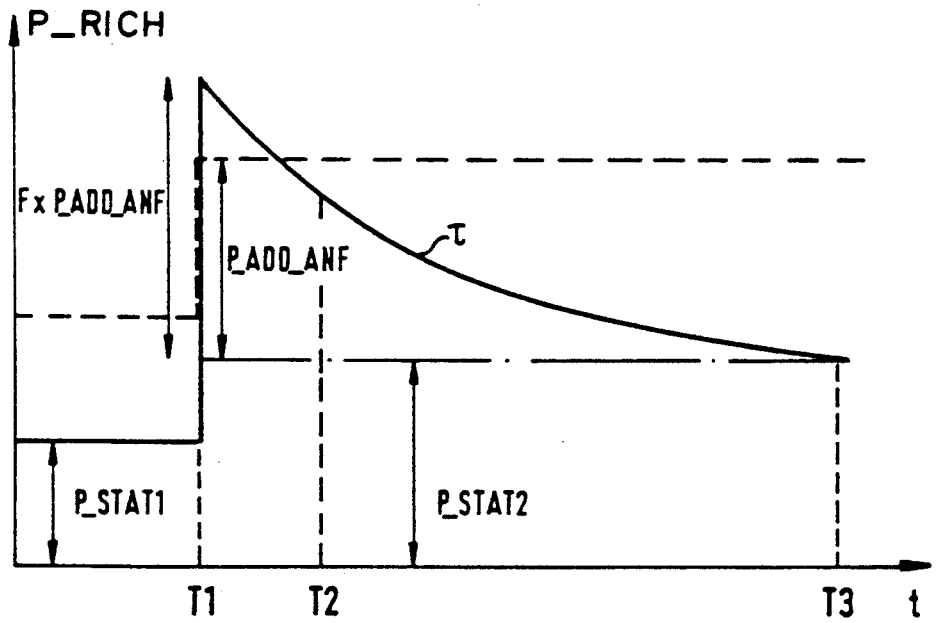
FIG. 2 is a diagram showing the time-dependent trace of the P-value as it occurs when applying a method or an arrangement according to FIG. 1 to a change in the operating state of an internal combustion engine; and, FIG. 3 is a block diagram corresponding to that of FIG. 1 but for a simplified embodiment.

In FIG. 2, the trace according to the conventional procedure is shown in phantom outline for the purpose of a comparison to the trace of P_RICH according to the invention. A value of 6% of the controller amplitude is used starting at time point T1 and starting at time point T1, a value of 9% is used. In steady-state operation, greater control oscillations with a more intense shift in the direction of rich are obtained in this way than are actually required for the smallest possible discharge of toxic gas during steady-state operation. In one transition time span between the time point T1 and a next time point T2, the conventional value for P_RICH which is held constant is, in contrast, less than the sum value according to the invention. In this transition time span, a response which is sufficient and adequately rapid cannot be obtained with the conventional constant value in order to hold the discharge of toxic gas as low as possible during the transition phase.

In the embodiment shown, the value for P_LEAN is taken directly from the corresponding characteristic field 10 and the value for P_RICH is changed only with output increases compared to the value read out of the steady-state value characteristic field 12. The last-mentioned selection takes place in that the difference unit 17 emits the value zero for negative values of $\Delta LMS/\Delta T$. This causes no new computation of the value of the transition variable to be made for output reductions. It has been shown that the temporary change of at least one control parameter is sufficient for output increases in such a direction that the control operates faster and the control position shifts in the direction of rich in order to obtain almost minimal toxic gas discharge. Further measures such as providing transition response for the variable P_LEAN or for output reductions only lead to slightly better improvements.

Figure 3:
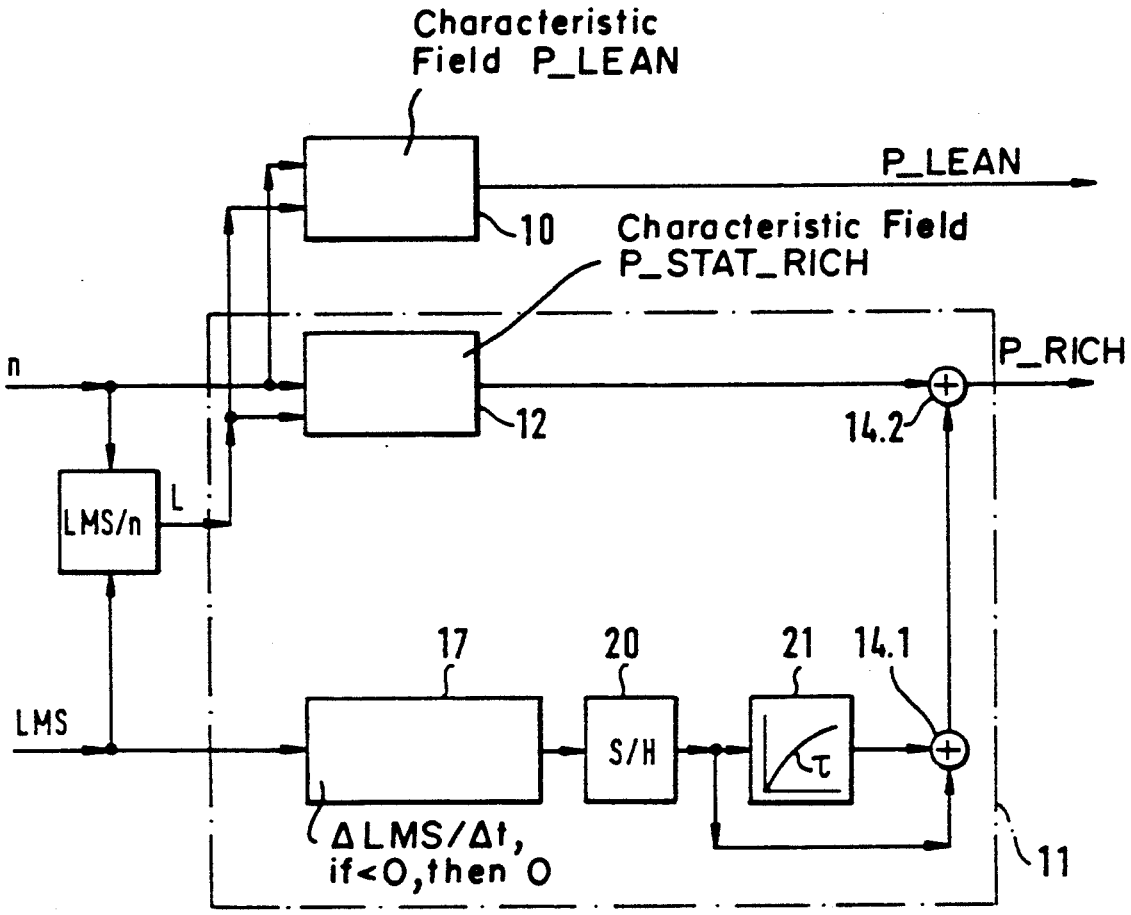

Very satisfactory results are obtained with a simplified embodiment as shown in FIG. 3 and which will now be explained in detail. Only the characteristic field 10 for values P_LEAN and the stationary value characteristic field 12 for values P_STAT_RICH are present as characteristic fields. The difference unit 17 now emits its output signal to a sample-and-hold circuit (S/H) 20. The output signal of the sample-and-hold circuit is controlled in time with the aid of a transition unit 21 of the first order and of a first summation unit 14.1. This decaying signal is added to the actual value P_STAT_RICH emitted by the steady-state value characteristic field 12 whereby the value P_RICH is obtained.

In this simplified embodiment, the amplitude of the time-decaying signal is always dependent only on the extent of a change but not on the operating point when the change occurs. The time constant for the decaying operation is pregiven. For each new change, the decaying value is computed independently of the previous value which still decays.

The embodiments relate to the time change of the value of P-jumps in the direction rich. However, any other control parameters could be changed such as unilateral integration speeds and switch points (control thresholds) in the case of a two-point-controller; or unilateral amplification factors, integration stop times or the desired value can be used for a continuous control. In the case of the just-mentioned continuous control, the characteristic field 10 for P_LEAN is unnecessary and the steady-state value characteristic field 12 no longer contains values for the steady-state of P_RICH but instead desired values for the steady-state case.

If a new output change takes place before the effects of the previous change have decayed, the decision with which value of the transition variable should be continued can also be obtained in another way than explained above with the operation of the maximum value determination unit 19 in the event that it should be made at all. Furthermore, it is possible to compute the time constant not directly with the aid of a new air-mass flow but instead, for example, to maintain the old value which is especially purposeful when a response is desired to output reductions as well as to output increases. The particular optimal procedure is very much dependent upon the dynamic performance of the controlled engine and also on the corresponding catalytic converter. Accordingly, the value of the time constant can also, for example, be coupled to the particular actual temperature change rate of a catalytic converter.

Addressing the characteristic fields must not necessarily take place via the particular actual values of engine speed (n) and load L (computed to LMS/n); instead, it can also be addressed via other values such as only via the intake pipe pressure.

What is alone essential is that at least one control parameter is computed as the sum of a base value optimized for steady-state operation and a transition value decaying after operating state changes of the engine being controlled.

It is understood that the foregoing description is that of the preferred embodiments of the invention and that various changes and modifications may be made thereto without departing from the spirit and scope of the invention as defined in the appended claims.

What is claimed is:

1. A method for adjusting control parameters of a lambda control for an internal combustion engine wherein an average value of lambda is associated with steady state operating points of the engine, the method comprising:

preselecting base values for the control parameters of the lambda control (P_STAT1, P_STAT2) in dependence upon operating points of the engine so that predetermined shifts of the average lambda value occur at steady state operating points of the engine;

modifying said base values with a time-decaying transition variable (P_ADD_ANF, F×P_ADD_ANF) when there is a change of the operating point of the engine so as to cause an additional shift of said average lambda value in the direction of a richer mixture during a change of the operating point; and, coupling a start value of said time-decaying transition value to a change of an operating variable of the engine within a short pregiven time span when there is a change of the operating point of the engine.

2. The method of claim 1, wherein said base value is logically combined with said transition value only when changing said operating variable in one direction.

3. The method of claim 1, wherein said transition variable has a start value which is dependent upon values of operating variables at the beginning of the change in the operating point of the engine.

4. The method of claim 3, wherein said start value of said transition variable is dependent upon the change of the value of said operating variable within a short pregiven time span.

5. The method of claim 1, wherein the time constant for the decay of said transition value is inversely dependent upon the air-mass flow into the engine.

6. The method of claim 1, wherein said base values are the desired values for a continuous lambda control.

7. The method of claim 1, wherein said operating variable of the engine is the air-mass flow (LMS) drawn in by the engine.

8. An arrangement for adjusting control parameters of a lambda control for an internal combustion engine wherein an average value of lambda is associated with steady state operating points of the engine, the arrangement comprising:

means for preselecting base values for the control parameters of the lambda control (P_STAT1, P_STAT2) in dependence upon operating points of the engine so that predetermined shifts of the average lambda value occur at steady state operating points of the engine;

means for modifying said base values with a time-decaying transition variable (P_ADD_ANF, F×P_ADD_ANF) when there is a change of the operating point of the engine so as to cause an additional shift of said average lambda value in the direction of a richer mixture during a change of the operating point; and, means for coupling a start value of said time-decaying transition value to a change of an operating variable of the engine within a short pregiven time span when there is a change of the operating point of the engine.

9. The arrangement of claim 8, said modifying means including a characteristic field for start values of said transition variable which can be addressed via values of said operating variable.

10. The arrangement of claim 9, said modifying means further including means for detecting output changes of the engine and means for influencing said start value of said transition variable in dependence upon the detected output change.

11. The arrangement of claim 8, wherein said operating variable of the engine is the air-mass flow (LMS) drawn in by the engine.

* * * * *

UNITED STATES PATENT AND TRADEMARK OFFICE

CERTIFICATE OF CORRECTION

PATENT NO. 5,291,873

DATED March 8, 1994

INVENTOR(S) Klaus Hirschmann, Lothar Raff, Lutz Reuschenbach and Eberhard Schnaibel

It is certified that error appears in the above-identified patent and that said Letters Patent is hereby corrected as shown below:

In column 3, line 54: delete "L=LMS/N" and substitute -- L=LMS/n -- therefor.

In column 4, line 34: delete "(ΔLMS/ΔT)" and substitute -- (ΔLMS/Δt) -- therefor.

In column 4, line 43: delete "constant 1" and substitute -- constant τ -- therefor.

In column 5, line 20: delete "ΔLMS/ΔT" and substitute -- ΔLMS/Δt -- therefor.

Signed and Sealed this

Twenty-eighth Day of June, 1994

*Attest:*

Bruce Lehman

BRUCE LEHMAN

*Attesting Officer*

*Commissioner of Patents and Trademarks*